US006896933B2

(12) United States Patent
Van Steenkiste et al.

(10) Patent No.: US 6,896,933 B2
(45) Date of Patent: May 24, 2005

(54) METHOD OF MAINTAINING A NON-OBSTRUCTED INTERIOR OPENING IN KINETIC SPRAY NOZZLES

(75) Inventors: Thomas Hubert Van Steenkiste, Ray, MI (US); John R. Smith, Birmingham, MI (US); Daniel William Gorkiewicz, Washington, MI (US); Alaa A. Elmoursi, Troy, MI (US); Bryan A. Gillispie, Warren, MI (US); Nilesh B. Patel, Macomb Township, MI (US)

(73) Assignee: Delphi Technologies, Inc., Troy, MI (US)

( * ) Notice: Subject to any disclaimer, the term of this patent is extended or adjusted under 35 U.S.C. 154(b) by 285 days.

(21) Appl. No.: 10/116,927

(22) Filed: Apr. 5, 2002

(65) Prior Publication Data

US 2003/0190413 A1 Oct. 9, 2003

(51) Int. Cl.[7] ..... B05D 1/02

(52) U.S. Cl. ..... 427/422; 427/446; 427/450; 427/451; 427/452; 427/453; 427/455; 427/456; 427/427; 427/189; 427/190; 427/191; 427/192; 427/193

(58) Field of Search ..... 427/446, 450, 427/451, 452, 453, 455, 456, 422, 427, 421, 421.1, 191, 192, 189, 190, 193

(56) References Cited

U.S. PATENT DOCUMENTS

| | | | | |
|---|---|---|---|---|
| 2,861,900 | A | 11/1958 | Smith et al. | |
| 3,100,724 | A | 8/1963 | Rocheville | |
| 3,993,411 | A | 11/1976 | Babcock et al. | |
| 4,263,335 | A | 4/1981 | Wagner et al. | |
| 4,416,421 | A | 11/1983 | Browning et al. | |
| 4,606,495 | A | 8/1986 | Stewart, Jr. et al. | |
| 4,891,275 | A | 1/1990 | Knoll | |
| 4,939,022 | A | 7/1990 | Palanisamy | |
| 5,187,021 | A | 2/1993 | Vydra et al. | |
| 5,271,965 | A | 12/1993 | Browning | |
| 5,302,414 | A | 4/1994 | Alknimor et al. | |
| 5,340,015 | A | 8/1994 | Hira et al. | |
| 5,395,679 | A | 3/1995 | Myers et al. | |
| 5,424,101 | A | 6/1995 | Atkins et al. | |
| 5,464,146 | A | 11/1995 | Zaluzec et al. | |
| 5,476,725 | A | 12/1995 | Papich et al. | |
| 5,527,627 | A | 6/1996 | Lautzenhiser et al. | |
| 5,593,740 | A | 1/1997 | Strumban et al. | |
| 5,795,626 | A | 8/1998 | Grabel et al. | |
| 5,854,966 | A | 12/1998 | Kampe et al. | |
| 5,894,054 | A | 4/1999 | Poruchuri et al. | |
| 5,907,761 | A | 5/1999 | Tohma et al. | |
| 5,952,056 | A | 9/1999 | Jordan et al. | |
| 5,989,310 | A | 11/1999 | Chu et al. | |
| 6,033,622 | A | 3/2000 | Maruyama | |
| 6,051,045 | A | 4/2000 | Narula et al. | |
| 6,051,277 | A | 4/2000 | Claussen et al. | |
| 6,074,737 | A | 6/2000 | Jordan et al. | |
| 6,129,948 | A | 10/2000 | Plummet et al. | |
| 6,139,913 | A | 10/2000 | Van Steenkiste et al. | |
| 6,283,386 | B1 | 9/2001 | Van Steenkiste et al. | |
| 6,338,827 | B1 | 1/2002 | Nelson et al. | |
| 6,344,237 | B1 * | 2/2002 | Kilmer et al. | 427/190 |
| 6,374,664 | B1 | 4/2002 | Bauer | |
| 6,402,050 | B1 | 6/2002 | Kashirin et al. | |
| 6,422,360 | B1 | 7/2002 | Oliver et al. | |
| 6,424,896 | B1 | 7/2002 | Lin | |
| 6,446,857 | B1 | 9/2002 | Kent et al. | |
| 6,465,039 | B1 * | 10/2002 | Pinkerton et al. | 427/132 |
| 6,485,852 | B1 | 11/2002 | Miller et al. | |
| 6,488,115 | B1 | 12/2002 | Ozsoylu | |
| 6,490,934 | B2 | 12/2002 | Garshelis | |

(Continued)

FOREIGN PATENT DOCUMENTS

| | | |
|---|---|---|
| DE | 42 36 911 | 12/1993 |
| DE | 199 59 515 | 6/2001 |
| DE | 100 37 212 | 1/2002 |
| DE | 101 26 100 | 12/2002 |
| EP | 1 160 348 | 12/2001 |
| EP | 1245854 A2 | 2/2002 |
| JP | 55031161 | 3/1980 |
| JP | 61249541 | 11/1986 |
| JP | 04180770 | 6/1992 |
| JP | 04243524 | 8/1992 |
| WO | 98/22639 | 5/1998 |
| WO | 02/052064 | 1/2002 |
| WO | 03009934 | 2/2003 |

OTHER PUBLICATIONS

Dykhuizen, et al.; *Gas Dynamic Principles of Cold Spray; Journal of Thermal Spray Technology*; 06–98; pp. 205–212.

McCune, et al; *An Exploration of the Cold Gas–Dynamic Spray Method for Several Materials Systems*, no date.

(Continued)

*Primary Examiner*—Katherine Bareford
(74) *Attorney, Agent, or Firm*—Scott A. McBain

(57) ABSTRACT

A method of maintaining a non-obstructed interior opening in a kinetic spray nozzle is disclosed. The method includes the steps of providing a mixture of particles including first particle population and a second particle population; entraining the mixture of particles into a flow of a gas at a temperature below the melt temperature of the particle populations; and directing the mixture of particles entrained in the flow of gas through a supersonic nozzle to accelerate the first particle population to a velocity sufficient to result in adherence of the first particle population on a substrate positioned opposite the nozzle. The operating conditions of the kinetic spray system are selected such that the second particle population is not accelerated to a velocity sufficient to result in adherence when it impacts the substrate. The inclusion of the second particle population maintains the supersonic nozzle in a non-obstructed condition and also enables one to raise the main gas operating temperature to a much higher level, thereby increasing the deposition efficiency of the first particle population.

23 Claims, No Drawings

U.S. PATENT DOCUMENTS

| | | | |
|---|---|---|---|
| 6,511,135 | B2 | 1/2003 | Ballinger et al. |
| 6,537,507 | B2 | 3/2003 | Nelson et al. |
| 6,551,734 | B1 | 4/2003 | Simpkins et al. |
| 6,553,847 | B2 | 4/2003 | Garshelis |
| 6,615,488 | B2 | 9/2003 | Anders |
| 6,623,704 | B1 | 9/2003 | Roth |
| 6,623,796 | B1 | 9/2003 | Van Steenkiste |
| 6,624,113 | B2 | 9/2003 | Labarge et al. |
| 2002/0071906 | A1 | 6/2002 | Rusch |
| 2002/0073982 | A1 | 6/2002 | Shaikh et al. |
| 2002/0102360 | A1 | 8/2002 | Subramanian et al. |
| 2002/0110682 | A1 * | 8/2002 | Brogan ..... 428/325 |
| 2002/0112549 | A1 | 8/2002 | Cheshmehdoost et al. |
| 2002/0182311 | A1 | 12/2002 | Leonardi et al. |
| 2003/0039856 | A1 | 2/2003 | Gillispie et al. |
| 2003/0190414 | A1 | 10/2003 | VanSteenkiste |
| 2003/0219542 | A1 | 11/2003 | Ewasyshyn et al. |

OTHER PUBLICATIONS

Ibrahim, et al; *Particulate Reinforced Metal Matrix Composites—A Review; Journal of Materials Science 26*; pp. 1137–1156, no date.

I.J. Garshelis, et al; *A Magnetoelastic Torque Transducer Utilizing a Ring Divided into Two Oppositely Polarized Circumferential Regions*; MMM 1995; Paper No. BB–08.

I.J. Garshelis, et al; *Development of a Non–Contact Torque Transducer for Electric Power Steering Systems*; SAE Paper No. 920707; 1992; pp. 173–182.

Boley, et al; *The Effects of Heat Treatment on the Magnetic Behavior of Ring—Type Magnetoelastic Torque Sensors*; Proceedings of Sicon '01; Nov. 2001.

McCune, et al; *An Exploration of the Cold Gas–Dynamic Spray Method* . . . ; Proc. Nat. Thermal Spray Conf. ASM Sep. 1995.

Pavel Ripka, et al; *Pulse Excitation of Micro–Fluxgate Sensors*, IEEE Transactions on Magnetics, vol. 37, No. 4, Jul. 2001, pp. 1998–2000.

Trifon M. Liakopoulos, et al; *Ultrahigh Resolution DC Magnetic Field Measurements Using Microfabricated Fluxgate Sensor Chips*, University of Cincinnati, Ohio, Center for Microelectronic Sensors and MEMS, Dept. of ECECS pp. 630–631, no date.

Derac Son, *A New Type of Fluxgate Magnetometer Using Apparent Coercive Field Strength Measurement*, IEEE Transactions on Magnetics, vol. 25, No. 5, Sep. 1989, pp. 3420–3422.

O. Dezauri, et al; *Printed Circuit Board Integrated Fluxgate Sensor*, Elsevier Science S. A. (2000) Sensors and Actuators, Pp. 200–203.

How, et al; *Generation of High–Order Harmonics in Insulator Magnetic Fluxgate Sensor Cores*, IEEE Transactions on Magnetics, vol. 37, No. 4, Jul. 2001, pp. 2448–2450.

Moreland, *Fluxgate Magnetometer*, Carl W. Moreland, 199–2000, pp. 1–9.

Ripka, et al; *Symmetrical Core Improves Micro–Fluxgate Sensors*, Sensors and Acutuators, Version 1, Aug. 25, 2000, pp. 1–9.

Hoton How, et al; *Development of High–Sensitivity Fluxgate Magnetometer Using Single–Crystal Yttrium Iron Garnet Thick Film as the Core Material, ElectroMagnnetic Applications, Inc*.

Ripka, et al; *Microfluxgate Sensor with Closed Core*, submitted for Sensors and Actuators, Version 1, Jun. 17, 2000.

Henriksen, et al; *Digital Detection and Feedback Fluxgate Magnetometer*, Meas. Sci. Technol. 7 (1996) pp.897–903.

Cetek 930580 Compass Sensor, *Specifications*, Jun. 1997.

Geyger, *Basic Principles Characteristics and Applications*, Magnetic Amplifier Circuits, 1954, pp. 219–232.

Van Steenkiste, et al; *Kinectic Spray Coatings*; in Surface & Coatings Technology III; 1999; pp.62–71.

Liu, et al; *Recent Development in the Fabrication of Metal Matrix–Particulate Composites Using Powder Metallurgy Techniques*: in Journal of Material Science 29; 1994; pp. 1999–2007; National University of Singapore, Japan.

Papyrin; *The Cold Gas–Dynamic Spraying Method a New Method for Coatings Deposition Promises a New Generation of Technologies; Novosibirsk, Russia*, no date.

McCune, al; Characterization of Copper and Steel Coatings Made by the Cold Gas–Dynamic Spray Method; National Thermal Spray Conference, no date.

Alkhimov, et al; *A Method of "Cold" Gas–Dynamic Deposition: Sov. Phys. Kokl. 36*(Dec. 12, 1990; pp. 1047–1049.

Dykuizen, et al; *Impact of High Velocity Cold Spray Particles*; in Journal of Thermal Spray Technology 8(4); 1999; pp.559–564.

Swariz, et al; *Thermal Resistance At Interfaces; Appl. Phys. Lett.*, vol. 51, No 26,28; Dec. 1987; pp. 2201–2202.

Davis, et al; *Thermal Conductivity of Metal–Matrix Composlites; J.Appl. Phys. 77* (*10*), May 15, 1995; pp. 4494–4960.

Stoner et al; *Measurements of the Kapitza Conductance between Diamond and Several Metals*; Physical Review Letters, vol. 68, No. 10; Mar. 9, 1992; pp. 1563–1566.

Stoner et al; *Kapitza conductance and heat flow between solids at temperatures from 50 to 300K; Physicai Review B*, vol. 48, No. 22, Dec. 1, 1993–II; pp. 16374;16387.

Johnson et al; *Diamond/Al metal matrix composites formed by the pressureless metal infiltration process*; J. Mater. Res., vol. 8, No. 5, May 1993; pp. 11691173.

Rajan et al; *Reinforcement coatings and interfaces in Aluminium Metal Matrix Composites*; pp. 3491–3503, 1998.

*LEC Manufacturing and Engineering Capabilities*; Lanxide Electronic Components, Inc., no date.

* cited by examiner

METHOD OF MAINTAINING A NON-OBSTRUCTED INTERIOR OPENING IN KINETIC SPRAY NOZZLES

INCORPORATION BY REFERENCE

U.S. Pat. No. 6,139,913, "Kinetic Spray Coating Method and Apparatus," and U.S. Pat. No. 6,283,386 "Kinetic Spray Coating Apparatus" are incorporated by reference herein.

TECHNICAL FIELD

The present invention is directed to a method for maintaining a non-obstructed interior opening in a kinetic spray system nozzle. The invention further permits one to increase the air flow temperature in the system thereby increasing deposition efficiency.

BACKGROUND OF THE INVENTION

A new technique for producing coatings on a wide variety of substrate surfaces by kinetic spray, or cold gas dynamic spray, was recently reported in an article by T. H. Van Steenkiste et al., entitled "Kinetic Spray Coatings," published in Surface and Coatings Technology, vol. 111, pages 62–71, Jan. 10, 1999. The article discusses producing continuous layer coatings having low porosity, high adhesion, low oxide content and low thermal stress. The article describes coatings being produced by entraining metal powders in an accelerated air stream, through a converging-diverging de Laval type nozzle and projecting them against a target substrate. The particles are accelerated in the high velocity air stream by the drag effect. The air used can be any of a variety of gases including air or helium. It was found that the particles that formed the coating did not melt or thermally soften prior to impingement onto the substrate. It is theorized that the particles adhere to the substrate when their kinetic energy is converted to a sufficient level of thermal and mechanical deformation. Thus, it is believed that the particle velocity must be high enough to exceed the yield stress of the particle to permit it to adhere when it strikes the substrate. It was found that the deposition efficiency of a given particle mixture was increased as the inlet air temperature was increased. Increasing the inlet air temperature decreases its density and increases its velocity. The velocity varies approximately as the square root of the inlet air temperature. The actual mechanism of bonding of the particles to the substrate surface is not fully unknown at this time. It is believed that the particles must exceed a critical velocity prior to their being able to bond to the substrate. The critical velocity is dependent not only on the material of the particle but also on the size of the particle. It is believed that the initial particles to adhere to a substrate have broken the oxide shell on the substrate material permitting subsequent metal to metal bond formation between plastically deformed particles and the substrate. Once an initial layer of particles has been formed on a substrate subsequent particles bind not only to the voids between previous particles bound to the substrate but also engage in particle to particle bonds. The bonding process is not due to melting of the particles in the air stream because the temperature of the air stream is always below the melting temperature of the particles and the temperature of the particles is always below that of the air stream.

This work improved upon earlier work by Alkimov et al. as disclosed in U.S. Pat. No. 5,302,414, issued Apr. 12, 1994. Alkimov et al. disclosed producing dense continuous layer coatings with powder particles having a particle size of from 1 to 50 microns using a supersonic spray.

The Van Steenkiste article reported on work conducted by the National Center for Manufacturing Sciences (NCMS) to improve on the earlier Alkimov process and apparatus. Van Steenkiste et al. demonstrated that Alkimov's apparatus and process could be modified to produce kinetic spray coatings using particle sizes of greater than 50 microns and up to about 106 microns.

This modified process and apparatus for producing such larger particle size kinetic spray continuous layer coatings are disclosed in U.S. Pat. Nos. 6,139,913, and 6,283,386. The process and apparatus provide for heating a high pressure air flow up to about 650° C. and combining this with a flow of particles. The heated air and particles are directed through a de Laval-type nozzle to produce a particle exit velocity of between about 300 m/s (meters per second) to about 1000 m/s. The thus accelerated particles are directed toward and impact upon a target substrate with sufficient kinetic energy to impinge the particles to the surface of the substrate. The temperatures and pressures used are sufficiently lower than that necessary to cause particle melting or thermal softening of the selected particle. Therefore, no phase transition occurs in the particles prior to impingement. It has been found that each type of particle material has a threshold critical velocity that must be exceeded before the material begins to adhere to the substrate.

One difficulty associated with all of these prior art kinetic spray systems arises from the configuration of the de Laval type nozzle. These converging-diverging nozzles typically converge from a diameter of approximately 7.0 to 10.0 mm down to a throat of from 2.0 to 3.0 mm and then diverge into a variety of shapes including rectangular openings of from 2.0 to 5.0 mm by 10.0 to 30.0 mm. The very narrow throat diameters cause the nozzles to plug very rapidly, requiring a shut down of the system and unplugging of the nozzle. Many times, depending on the particle material, gas temperature and velocity the nozzles may plug in as short as 1 minute or less. Each type of particle material has a threshold critical velocity at which it will start to adhere to the interior of the nozzle. The critical velocity is dependent on both the particle size and its material composition. The surfaces inside the nozzle must be kept free of obstructions to enable proper coating. Partial plugging is also a problem because the coated surface may appear to be good, however, internal defects will result in poor mechanical properties. Clearly, this severely limits the practical usefulness of the method. Thus, it would be highly desirable to provide a system and method to greatly reduce or eliminate this problem. It would also be highly beneficial to raise the temperature of the main gas while preventing plugging as this increases the deposition efficiency.

SUMMARY OF THE INVENTION

In a first embodiment, the present invention is a method of kinetic spray coating a substrate that comprises the steps of: providing a mixture of particles comprising a first particle population and a second particle population; entraining the mixture of particles into a flow of a gas, the gas at a temperature below a melt temperature of the first particle population and below a melt temperature of the second particle population; directing the mixture of particles entrained in the flow of gas through a supersonic nozzle and accelerating the first particle population to a velocity sufficient to result in adherence of the first particle population on a substrate positioned opposite the nozzle, and accelerating the second particle population to a velocity insufficient to result in adherence of the second particle population to either the nozzle or the substrate when it impacts the substrate.

In a second embodiment the present invention comprises a method of kinetic spray coating a substrate comprising the steps of: selecting a first particle population having a first average nominal diameter; selecting a second particle population having a second average nominal diameter that is larger than the first average nominal diameter; forming a mixture of particles by combining the first particle population with the second particle population; entraining the mixture of particles into a flow of a gas, the gas at a temperature below a melt temperature of the first particle population and below a melt temperature of the second particle population; directing the mixture of particles entrained in the flow of gas through a supersonic nozzle and simultaneously accelerating the first particle population to a velocity sufficient to result in adherence of the first particle population on a substrate positioned opposite the nozzle, while accelerating the second particle powder to a velocity insufficient to result in adherence of the second particle population to either the nozzle or the substrate when it impacts the substrate.

DESCRIPTION OF THE PREFERRED EMBODIMENT

The present invention comprises an improvement to the kinetic spray process, described briefly below, as generally described in U.S. Pat. No. 6,139,913 and the article by Van Steenkiste, et al. entitled "Kinetic Spray Coatings" published in Surface and Coatings Technology Volume III, Pages 62–72, Jan. 10, 1999, both of which are herein incorporated by reference.

As disclosed in U.S. Pat. No. 6,139,913 a kinetic spray apparatus generally comprises three components. The first component is a powder inlet that supplies a particle powder mixture to the system under a pressure that exceeds that of the heated main gas. The powder inlet joins a heated high pressure gas flow in a mixing chamber and the mixture of particles and heated gas are flowed into a de Laval-type nozzle. This nozzle produces an exit velocity of greater than 300 meters per second and as high as 1200 meters per second of the entrained particles. The entrained particles gain kinetic and thermal energy during their flow through this nozzle. It will be recognized by those of skill in the art that the temperature of the particles in the gas stream will vary depending on the particle size and the main gas temperature. The main gas temperature is defined as the temperature of heated high-pressure gas at the inlet to the nozzle. Since these temperatures are substantially less than the melting point of the particles, even upon impact, there is no change in the solid phase of the original particles due to transfer of kinetic and thermal energy, and therefore no change in their original physical properties. The particles are always at a temperature below the main gas temperature. The particles exiting the nozzle are directed toward a surface of a substrate to coat it. Upon striking a substrate opposite the nozzle the particles flatten into a nub-like structure with an aspect ratio of about 5 to 1. When the substrate is a metal and the particles are a metal the particles striking the substrate surface fracture the oxidation on the surface layer and subsequently form a direct metal-to-metal bond between the metal particle and the metal substrate. Upon impact the kinetic sprayed particles transfer substantially all of their kinetic and thermal energy to the substrate surface and stick if their yield stress has been exceeded. As discussed above, for a given particle to adhere to a substrate it is necessary that it reach or exceed its critical velocity which is defined as the velocity where at it will adhere to a substrate when it strikes the substrate after exiting the nozzle. This critical velocity is dependent on the material composition of the particle. In general, harder materials must achieve a higher critical velocity before they adhere to a given substrate. Also, in general larger particles of the same material require a longer acceleration time to reach the critical velocity than smaller particles of the same material. It is not known at this time exactly what is the nature of the particle to substrate bond; however, it is believed that a portion of the bond is due to the particles plastically deforming upon striking the substrate. All of the particles likewise have a similar critical velocity that when exceeded will cause them to adhere to the inside of the nozzle as they strike the inside of the nozzle during passage through the nozzle.

As disclosed in U.S. Pat. No. 6,139,913 the substrate material may be comprised of any of a wide variety of materials including a metal, an alloy, a semi-conductor, a ceramic, a plastic, and mixtures of these materials. All of these substrates can be coated by the process of the present invention.

In the present invention, the substrates are coated with a first particle population, which may comprise any one of a number of materials. Preferably, the first particle population comprises at least one of a metal, an alloy, or a mixture of a metal and an alloy. It can also comprise a ceramic or mixtures of these materials. The first particle population can thus comprise a wide variety of materials. Preferably, the first particle population has a first average nominal particle size of from 50 to 106 microns, with the preferable range being 75 to 106 microns. As described below, the operating parameters of the kinetic spray system are chosen to accelerate the first particle population to a velocity at or above its critical velocity whereupon when it strikes a substrate placed opposite the nozzle it will subsequently bind to the substrate surface. As is known by those of skill in the art, different particle powders will require different operating conditions such as changes in the main gas temperature, changes in the pressure and distance between the nozzle and the substrate. As utilized in the present specification and claims, the term "first particle population" means a particle population that under the selected operating conditions of the kinetic spray system will adhere to a substrate placed opposite the nozzle.

As discussed above, one of the common difficulties with kinetic spray systems is frequent and rapid plugging of the throat of the de Laval-type nozzle, especially when the temperature of the main gas approaches the threshold temperature of the first particle population and when the first particle population approaches its critical velocity. The threshold temperature of the first particle population is the temperature at which it begins to adhere to the interior surfaces of the nozzle. This temperature obviously varies as does the critical velocity depending on the identity of the first particle population. For example, with aluminum the threshold temperature is approximately 550° F. while the threshold temperature for tin is approximately 400° F.

The present invention differs from the prior art in the utilization of a second particle population in combination with the first particle population. As utilized in the present specification and claims, the term "second particle population" means a particle population that under the operating conditions chosen for the kinetic spray system the particles of the second population particle are not accelerated to a sufficient velocity for them to adhere to a substrate placed opposite the nozzle, instead, these particles leave the nozzle, strike the substrate, and bounce off unlike the first particle population. Also, the second particle population does not stick to the inside of the nozzle. When one applies very thick coatings of the first particle population some of the second particle population is trapped by the first particle population onto the substrate surface, however, the conditions of the kinetic spray system are selected such that the second particle population would not normally adhere to the substrate or the nozzle.

As discussed above, there are two ways by which one can select the second particle population. A first way is to select a particle population that comprises the same material as the first particle population, however, having a second average nominal particle diameter that is significantly larger than the first average nominal particle diameter of the first particle population. Preferably, the second particle population has an average nominal diameter that exceeds the average nominal diameter of the first particle population by a factor of two or more. Thus, the second particle population can have an average nominal diameter preferably of from about 100 to 300 microns. A second way to select the second particle population is to select a material that has a higher yield stress than that of the first particle population. The yield stress is in part a function of the hardness of the material and can also be estimated by comparing the Young's modulus values of two materials. Preferably the second particle population exceeds the hardness or Young's modulus of the first particle population by a factor of 1.5 fold. Thus, by selecting as the material for the second particle population a material having a hardness that is significantly harder than that of the first particle population one can utilize first and second particle populations having the same or similar average nominal diameters. Examples of some of the second particle populations include copper, tungsten, diamond, molybdenum, ceramics such as silicon carbide and aluminum nitride.

In utilizing the present invention the first particle population is combined with the second particle population to form a mixture of particles. The mixture of particles are flowed into the heated main gas which is at a temperature below the melt temperature of the populations. The combined mixture of particles is directed through the de Laval-type nozzle wherein the first particle population is accelerated to a velocity in excess of its critical velocity. The accelerated first particle population strikes the substrate and adheres as discussed above. Preferably, the second particle population comprises from 3 to 50% by volume of the particle mixture, with the remainder being made up of the first particle population. The main gas operating temperature core ranges from 200 to 3000° F. The method of the present invention is further described below in a series of examples showing the advantages of the method. The main gas can comprise air, helium, or other gases.

EXAMPLE I

In a first series of experiments the effect of utilizing second particle population of copper in combination with a first particle population of tin was tested. In Table 1, below, are presented the results of testing addition of a copper particle population to a tin particle population. All of the samples were run through a de Laval-type nozzle having a throat of 3 millimeters and a rectangular shaped opening of approximately 4.7 millimeters by 12 millimeters. The main gas temperature was set at 400° F.

TABLE 1

| Percent Copper by Volume | Run Time, Minutes | Observations |
|---|---|---|
| 0.0 | 4 | Nozzle throat completely plugged. |

TABLE 1-continued

| Percent Copper by Volume | Run Time, Minutes | Observations |
|---|---|---|
| 6.0 | 20 | Small build-up of material in the nozzle. |
| 12.0 | 20 | Nozzle completely clean. |
| 25.0 | 20 | Nozzle completely clean. |

As can be seen from the data above, inclusion of a small portion of copper along with the tin enables the tin to be run for a much longer period of time. In the absence of copper, tin completely plugged the nozzle within 4 minutes, whereas in the presence of copper after a run of 20 minutes the nozzle was still perfectly clean. Tin has a melting point of 232° C., while copper has a melting point of 1083° C., thus the cooper can scour the nozzle and keep it clean whereas the tin will stick to it.

EXAMPLE 2

In this example, the addition of a copper particle population to a tin particle population was tested utilizing a de Laval nozzle having a throat diameter of 2 millimeters and a rectangular shaped opening of approximately 2.8 millimeters by 27.4 millimeters. The combination of copper with tin was tested at a series of copper levels and main gas operating temperatures.

TABLE 2

| Main Gas Temperature, Degrees F. | Percent Copper by Volume | Run Time, Minutes | Observations |
|---|---|---|---|
| 400 | 0.0 | 0.5 | Nozzle completely plugged. |
| 400 | 6.0 | 20 | A small amount of build-up observed inside the nozzle. |
| 400 | 12.0 | 20 | Nozzle extremely clean. |
| 400 | 25.0 | 20 | Nozzle extremely clean. |
| 200 | 25.0 | 20 | Nozzle extremely clean. |
| 300 | 25.0 | 20 | Nozzle extremely clean. |
| 500 | 25.0 | 20 | Nozzle extremely clean. |

The results disclosed in Table 2 show that upon addition of copper to tine one is able to dramatically extend the run time from less than a minute to well over 20 minutes. The runs were stopped at 20 minutes for observation, however, inclusion of copper with the tin enables the run time to be extended well beyond 20 minutes. The results also demonstrate that one is able to raise the temperature of the main gas from 400° F. to 500° F. while maintaining a non-obstructed nozzle. This is important because, as discussed above, increasing the main gas temperature increases the deposition efficiency of a first particle population onto the substrate.

EXAMPLE 3

Utilizing aluminum as the first particle population a series of second particle populations were tested, all at a level of 50% by volume based on the total volume of the particle mixture, to determine whether they would maintain a non-obstructed nozzle and to determine the maximal temperature of the main gas that could be utilized without obstruction of the nozzle.

TABLE 3

| Second Particle Population | Main Gas Temperature, Degree F. | Comments |
|---|---|---|
| None | 550 | Nozzle completely plugged in less than 1 minute. |
| Silicon Carbide | 700 | No deposits when observed after 2 minutes. |
| Aluminum Nitride | 700 | No deposits when observed after 2 minutes. |
| Tungsten | 700 | No deposits when observed after 2 minutes. |
| Molybdenum | 700 | No deposits when observed after 2 minutes. |
| Diamond | 700 | No deposits when observed after 2 minutes. |
| Copper | 900 | No deposits when observed after 2 minutes. |

As can be seen from results of Table 3, inclusion of a range of second particle populations along with a first particle population of aluminum allows the aluminum to be sprayed at much higher temperatures while preventing obstruction of the nozzle. The test runs were stopped after 2 minutes for observation; however, with the second particle populations the run times can be extended well beyond 20 minutes at these elevated temperatures. Aluminum has a Young's modulus of 69 Gpa. The values for copper, tungsten, silicon carbide, and diamond are 124, 406, 450 and 1000, respectively.

EXAMPLE 4

A mixture of first particle populations was tested in combination with the second particle population of silicon carbide to determine whether the silicon carbide was able to maintain the nozzle in a non-obstructed condition. The first particle population was a mixture of 12% zinc, 78% aluminum, and 10% silicon. In the absence of silicon carbide the nozzle was clogged in less than 10 minutes when the main gas temperature was 600° F. In the presence of either 3 or 10% by volume silicon carbide, the main gas temperature could be raised to 1000° F. and after more than 20 minutes there was no detectable clogging in the nozzle. This experiment demonstrates the value of the second particle population in both preventing clogging of the nozzles and enabling one to run at much higher main gas temperatures.

While the preferred embodiment of the present invention has been described so as to enable one skilled in the art to practice the present invention, it is to be understood that variations and modifications may be employed without departing from the concept and intent of the present invention as defined in the following claims. The preceding description is intended to be exemplary and should not be used to limit the scope of the invention. The scope of the invention should be determined only by reference to the following claims.

What is claimed is:

1. A method of kinetic spray coating a substrate comprising the steps of:

a) providing a mixture of particles comprising a first particle population and a second particle population, said first particle population having an average nominal diameter of from 75 to 106 microns and said second particle population having an average nominal diameter of from 75 to 300 microns;

b) entraining the mixture of particles into a flow of a gas, the gas at a temperature below a melt temperature of the first particle population and below a melt temperature of the second particle population;

c) directing the mixture of particles entrained in the flow of gas through a supersonic nozzle and simultaneously accelerating the first particle population to a velocity sufficient to result in adherence of the first particle population on a substrate positioned opposite the nozzle, while accelerating the second particle population to a velocity insufficient to result in adherence of the second particle population to either the nozzle or the substrate when it impacts the substrate.

2. The method of claim 1, wherein step a) comprises selecting as the first particle population a material having a first yield stress and selecting as the second particle population a material having a second yield stress, wherein the first yield stress is lower than the second yield stress.

3. The method of claim 1, wherein step a) comprises selecting as the first particle population a material having a first average nominal particle size and selecting as the second particle population a material having a second average nominal particle size, wherein the second average nominal particle size is at least twice the first average nominal particle size.

4. The method of claim 3, wherein step a) further comprises selecting the material of the first particle population to be the same as the material of the second particle population.

5. The method of claim 3, wherein step a) further comprises selecting the material of the first particle population to be other than the material of the second particle population.

6. The method of claim 1, wherein step a) further comprises providing the second particle population in an amount of from 3 to 50 percent by volume based on the total volume of the mixture of particles.

7. The method of claim 1, wherein step a) further comprises selecting as the first particle population at least one of a metal or an alloy.

8. The method of claim 1, wherein step a) further comprises selecting as the second particle population at least one of a metal, an alloy, a diamond, or a ceramic.

9. The method of claim 8, wherein step a) further comprises selecting as the second particle population at least one of copper, aluminum, tin, zinc, tungsten, molybdenum, silicon carbide, or aluminum nitride.

10. The method of claim 1, wherein step b) further comprises setting the gas at a temperature of from 200° F. to 3000° F.

11. The method of claim 1, wherein step c) further comprises selecting as the substrate at least one of a metal, an alloy, a ceramic, or a plastic.

12. The method of claim 1, wherein step a) comprises selecting as the first particle population a first material having a first average nominal particle size and selecting as the second particle population the first material having a second average nominal particle size, wherein the second average nominal particle size is larger than the first average nominal particle size; and the first particle population is accelerated to a velocity that is greater than the velocity of the second particle population.

13. The method of claim 1, wherein step a) comprises selecting as the first particle population a first material having a first yield stress and a first average nominal particle size and selecting as the second particle population a second material having a second yield stress and a second average nominal particle size, wherein the first yield stress is lower than the second yield stress, the second average nominal particle size is smaller than the first average nominal particle size, and the second particle population is accelerated to a higher velocity than the first particle population.

14. The method of claim 1, wherein step a) comprises selecting as the first particle population a first material having a first yield stress and selecting as the second particle population a second material having a second yield stress, wherein the first yield stress is lower than the second yield stress, the first and second particle populations have the same average nominal particle size, and the first and second particle populations are accelerated to the same velocity.

15. The method of claim 1, wherein step a) comprises selecting as the first particle population a first material having a first yield stress and a first average nominal particle size and selecting as the second particle population a second material having a second yield stress and a second average nominal particle size, wherein the first yield stress is lower than the second yield stress, the first average nominal particle size is smaller than the second average nominal particle size and the first particle population is accelerated to a greater velocity than the second particle population.

16. A method of kinetic spray coating a substrate comprising the steps of:

a) selecting a first particle population having a first average nominal diameter of from 75 to 106 microns;

b) selecting a second particle population having a second average nominal diameter that is larger than the first average nominal diameter;

c) forming a mixture of particles by combining the first particle population with the second particle population;

d) entraining the mixture of particles into a flow of a gas, the gas at a temperature below a melt temperature of the first particle population and below a melt temperature of the second particle population;

e) directing the mixture of particles entrained in the flow of gas through a supersonic nozzle and simultaneously accelerating the first particle population to a velocity sufficient to result in adherence of the first particle population on a substrate positioned opposite the nozzle, while accelerating the second particle powder to a velocity insufficient to result in adherence of the second particle population to either the nozzle or the substrate when it impacts the substrate.

17. The method of claim 16, wherein step b) comprises selecting the second particle population to have a second average nominal diameter of from 100 to 300 microns.

18. The method of claim 16, wherein step b) comprises selecting the second particle population to have a second average nominal diameter that is at least twice as large as the first average nominal diameter.

19. The method of claim 16, further comprising selecting a material of the first particle population to be the same as a material of the second particle population.

20. The method of claim 16, further comprising selecting a material of the first particle population to be other than a material of the second particle population.

21. The method of claim 16, wherein step c) further comprises providing the second particle population in an amount of from 3 to 50 percent by volume based on the total volume of the mixture of particles.

22. The method of claim 16, wherein step a) further comprises selecting as the first particle population at least one of aluminum, copper, tungsten, molybdenum, tin, zinc, silicon, or mixtures thereof.

23. The method of claim 16, wherein step b) further comprises selecting as the second particle population at least one of copper, aluminum, tin, zinc, tungsten, molybdenum, silicon carbide, aluminum nitride, ceramic, or mixtures thereof.

* * * * *